US007338186B1

(12) United States Patent
Wu et al.

(10) Patent No.: US 7,338,186 B1
(45) Date of Patent: Mar. 4, 2008

(54) ASSEMBLED STRUCTURE OF LARGE-SIZED LED LAMP

(75) Inventors: Chung Wu, Taipei (TW); Meng-Cheng Huang, Taipei (TW); Zu-Chao Hsu, Taipei (TW)

(73) Assignee: Chaun-Choung Technology Corp., Taipei (TW)

( * ) Notice: Subject to any disclaimer, the term of this patent is extended or adjusted under 35 U.S.C. 154(b) by 0 days.

(21) Appl. No.: 11/468,626

(22) Filed: Aug. 30, 2006

(51) Int. Cl.
*F21V 29/00* (2006.01)
*F21V 11/00* (2006.01)
*F21V 1/00* (2006.01)

(52) U.S. Cl. ..... 362/294; 362/240; 362/248; 362/373; 362/800

(58) Field of Classification Search ..... 362/294, 362/373, 153.1, 800, 545, 227, 249, 240, 362/246, 547, 248, 218, 345; 257/88, 98, 257/675

See application file for complete search history.

(56) References Cited

U.S. PATENT DOCUMENTS 5,560,706 A * 10/1996 Yamazaki et al. ..... 362/549
2003/0189829 A1* 10/2003 Shimizu et al. ..... 362/240
2004/0257808 A1* 12/2004 Bjornson et al. ..... 362/249
2005/0047140 A1* 3/2005 Chang ..... 362/267
2006/0087843 A1* 4/2006 Setomoto et al. ..... 362/249
2006/0255359 A1* 11/2006 Sun et al. ..... 257/100
2007/0081338 A1* 4/2007 Kuan ..... 362/294
2007/0090737 A1* 4/2007 Hu et al. ..... 313/11
2007/0230184 A1* 10/2007 Shuy ..... 362/294

FOREIGN PATENT DOCUMENTS

JP 2005285446 A * 10/2005

OTHER PUBLICATIONS

Derwent English Abstract of Japanese Publication JP 2005285446 A.*

* cited by examiner

*Primary Examiner*—Alan Cariaso
*Assistant Examiner*—Kevin J. Spinella

(57) ABSTRACT

An assembled structure of a large-sized LED lamp includes a substrate. One surface of the substrate is provided with a plurality of LED modules. Each LED module comprises a circuit board and a plurality of LEDs fixedly connected to the circuit board. A lamp mask is locked onto the substrate to cover and protect the LED modules. A sealing material is provided between the lamp mask and the substrate to protect the permeation of liquid. Further, at the positions of the other surface of the substrate, heat-dissipating modules are provided to correspond to each LED module, respectively. The heat-dissipating modules are used to dissipate heat generated from the LEDs. A lamp cover is covered to the exterior of the heat-dissipating modules. The lamp cover is locked onto the substrate. With the modulization of each constituent element, the detachment, assembly and repair of the present invention can be much simpler and more convenient.

8 Claims, 6 Drawing Sheets

ASSEMBLED STRUCTURE OF LARGE-SIZED LED LAMP

BACKGROUND OF THE INVENTION

1. Field of the Invention

The present invention relates to an assembled structure of a large-sized LED lamp, and in particular to a large-sized LED lamp constituted of a plurality of LED modules, thereby to facilitate its detachment, assembly and repair.

2. Description of Prior Art

Since light-emitting diodes (LED) have many advantages over the conventional bulbs, such as compact in size, electricity-saved and cheaper price, they are widely used in illumination devices. The light-emitting diodes have been made to provide high efficiency, power and intensity.

Since the intensity of the light emitted by single light-emitting diode is smaller than that of a conventional bulb, a plurality of light-emitting diodes are usually soldered to a circuit board, thereby to increase the intensity of light. In this way, the drawback of insufficient illumination can be overcome.

However, all the LEDs of the conventional lamp are integrally formed on a substrate. In the case of a large-sized lamp, such as a streetlamp, it is necessary to install almost a hundred of LEDs. If any LED is damaged, in order to perform the repair, the whole substrate should be replaced. Therefore, in most cases, after a certain number of LEDs have been damaged, the repair and replacement of the damaged LEDs are carried out, which causes inconvenience in use and illumination.

In view of the above, the inventor proposes the present invention to overcome the above problems based on his expert experiences and deliberate researches.

SUMMARY OF THE INVENTION

The present invention is to provide an assembled structure of a large-sized LED lamp including a substrate. One surface of the substrate is provided with a plurality of LED modules. Each LED module comprises a circuit board and a plurality of LEDs fixedly connected to the circuit board. A lamp mask is locked onto the substrate to cover and protect the LED modules. A sealing material is provided between the lamp mask and the substrate to protect the permeation of liquid. Further, at the positions of the other surface of the substrate, heat-dissipating modules are provided to correspond to each LED module, respectively. The heat-dissipating modules are used to dissipate heat generated from the LEDs. A lamp cover is covered to the exterior of the heat-dissipating modules. The lamp cover is locked onto the substrate.

With the above arrangement, since the large-sized LED lamp of the present invention is constituted of a plurality of LED modules, when the LEDs of a certain LED module are damaged, only that LED module should be replaced without replacing or repairing all the LED modules. Therefore, the detachment, assembly and repair of the present invention are much simpler and convenient.

DETAILED DESCRIPTION OF THE INVENTION

The detailed description and the technical contents of the present invention will be made with reference to the accompanying drawings. However, it should be understood that the drawings are illustrative but not used to limit the scope of the present invention.

Figure 1:
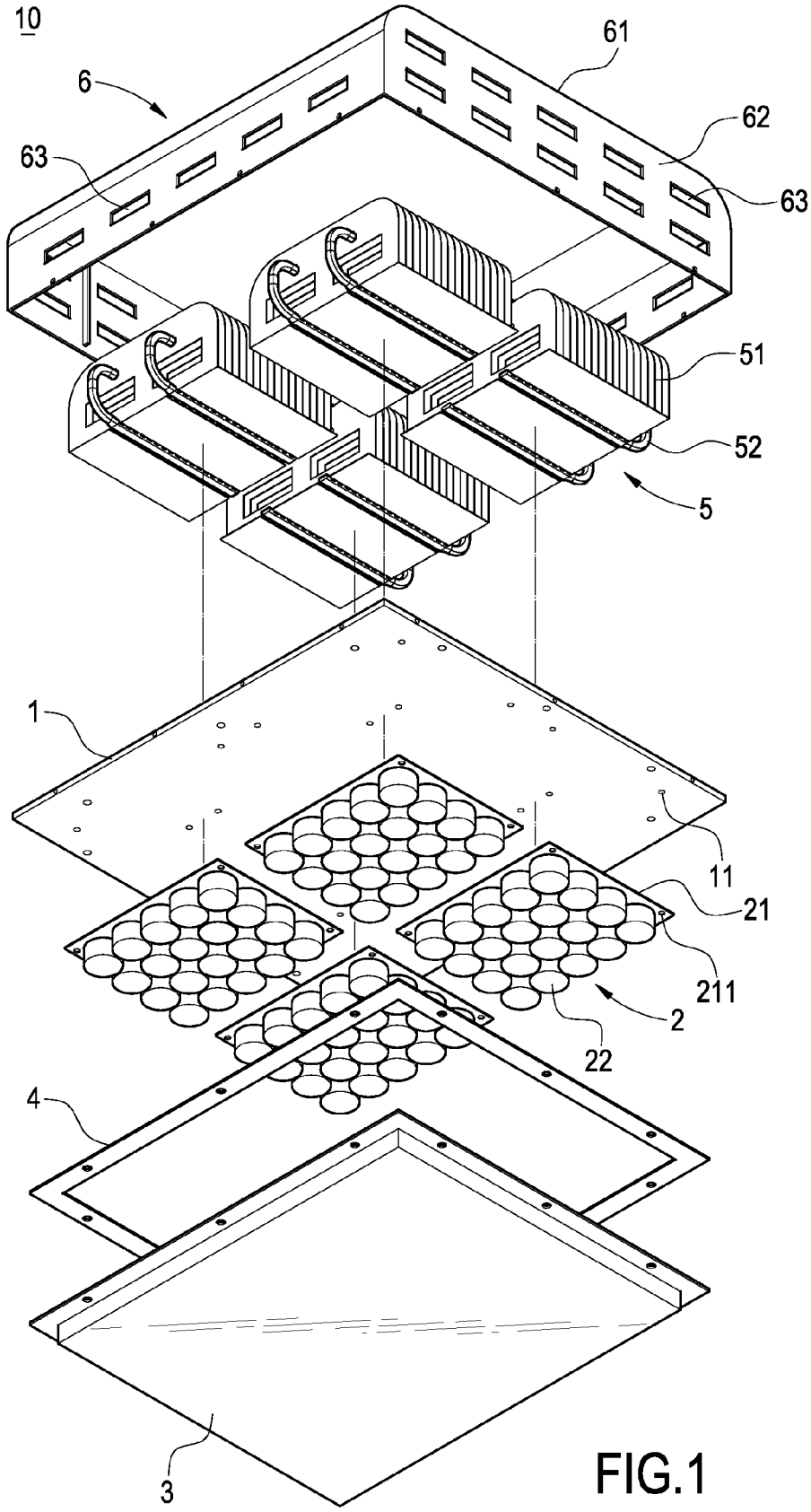
FIG. 1 is an exploded perspective view of the present invention.

The present invention is directed to an assembled structure of a large-sized LED lamp. With reference to FIG. 1, the large-sized LED lamp 10 includes a substrate 1 made of heat-conducting or heat-dissipating material (such as aluminum). The substrate 1 can be used to dissipate the heat and even function as a fixing plate. The button surface of the substrate 1 is provided with a plurality of LED modules 2. In the present embodiment, there are four LED modules 2. Each LED module 2 has a circuit board 21 and a plurality of LEDs 22 soldered in an array on the circuit board 21. At each corner of the circuit board 21, a locking hole 211 is provided. Further, at the positions of substrate 1, screw holes 11 are provided to correspond to the locking holes 211, respectively, so that each circuit board 21 can be locked on the bottom surface of the substrate 1 by the bolt elements 23 (FIG. 2).

Further, the LED modules 2 are enclosed on a substrate 1 via a large rectangular lamp mask 3. The shape of the periphery of the lamp mask 3 is not greater (that is, equal to or smaller than) than that of the periphery of the substrate 1 so as to cover and protect the LED modules 2. Between the lamp mask 3 and the substrate 1, a sealing material 4 is provided to protect the permeation of the liquid such as water or moisture. In the present embodiment, the sealing material 4 can be formed of foam having a hollow rectangular frame.

In the present invention, at the positions of the top surface of the substrate 1, heat-dissipating modules 5 are provided to correspond to each LED module 2, respectively. The heat-dissipating modules 5 are used to dissipate the heat generated by the LEDs 22. Each heat-dissipating module 5 comprises a plurality of heat-dissipating fins 51 arranged at identical intervals and two U-shaped heat pipes 52 penetrating through the heat-dissipating fins 51. In the heat pipe 52, a working fluid and a capillary structure are provided. One end of the heat pipe 52 penetrates through the heat-dissipating fins 51, and the other end is exposed from the bottom surface. With this arrangement, the heat pipe 52 can abut against the substrate 1 to perform the heat conduction. The heat-dissipating modules 5 are locked on the substrate 1 by a lamp cover 6 and thus are also protected by the lamp cover 6. The lamp cover 6 is constituted of a rectangular top plate 61 and a plurality of surrounding plates 62 extending downwardly from the periphery of the top plate 61. A plurality of venting holes 63 is provided on each surrounding plate 62.

Figure 2:
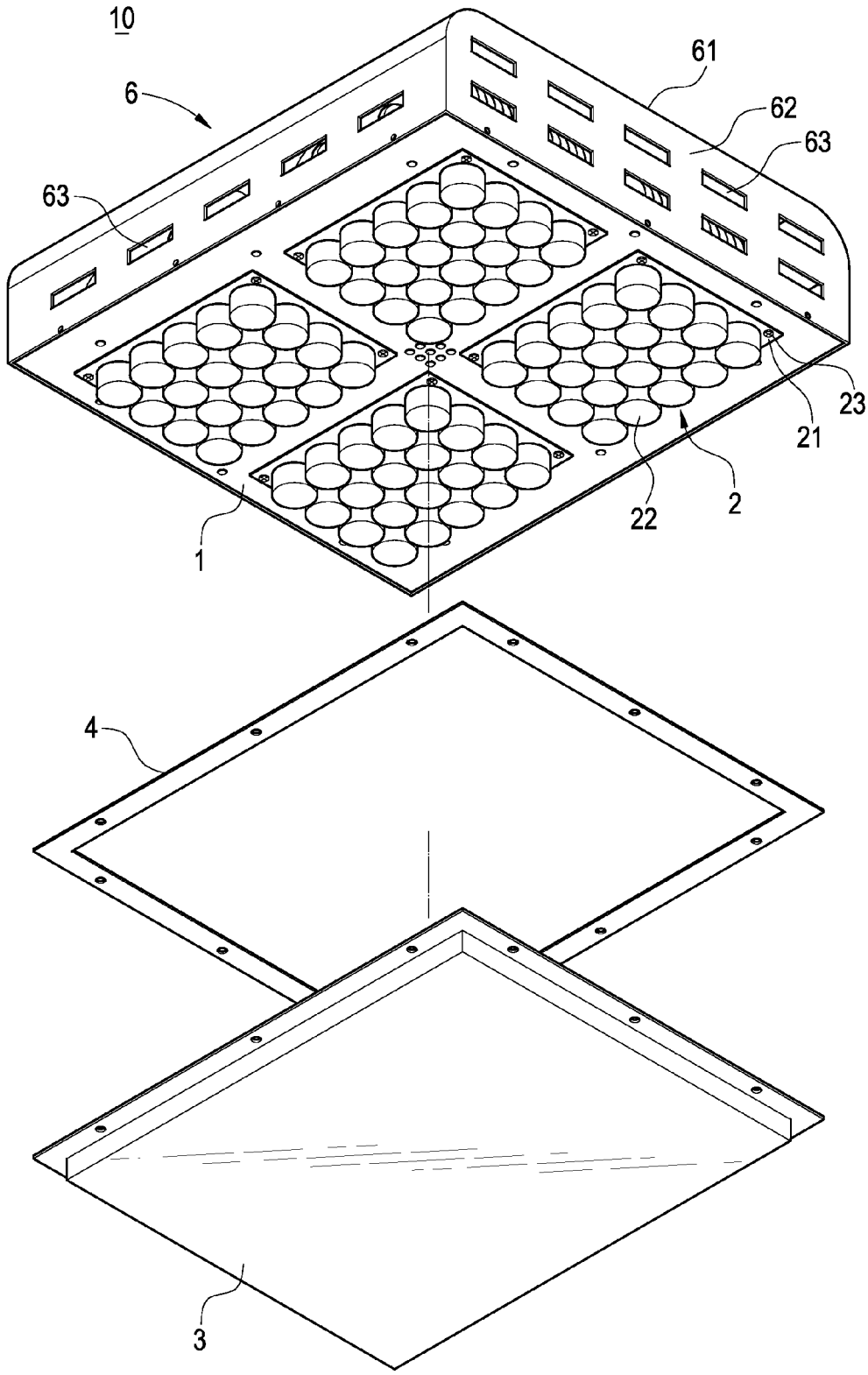
FIG. 2 is a partially assembled view of the present invention.

With reference to FIG. 2, during the assembly of the present invention, the plurality of heat-dissipating modules 5 is disposed on the top surface of the substrate 1. A solder paste is applied between the heat-dissipating modules 5 and the substrate 1. Then, by melting at high temperature, the heat-dissipating modules 5 can be fixed on the substrate 1.

Next, the lamp cover 6 is locked on the substrate 1 to cover and protect the heat-dissipating modules 5. Also, the plurality of LED modules 2 is locked on the bottom surface of the substrate 1 by the bolt elements 23, so that each LED module 2 corresponds to a heat-dissipating module 5. Finally, the sealing material 4 and the lamp mask 3 are locked to the bottom surface of the substrate 1 to cover and protect the LED modules 2. In this way, the assembly of a large-sized LED lamp 10 is completed.

In the present invention, when some LEDs 22 on a certain LED module 2 are damaged, only the lamp mask 3 and the damaged LED module 2 need to be detached. It is not necessary to detach or replace all the LED modules 2, thereby to increase the simplicity of repair and the convenience in use.

Figure 3:
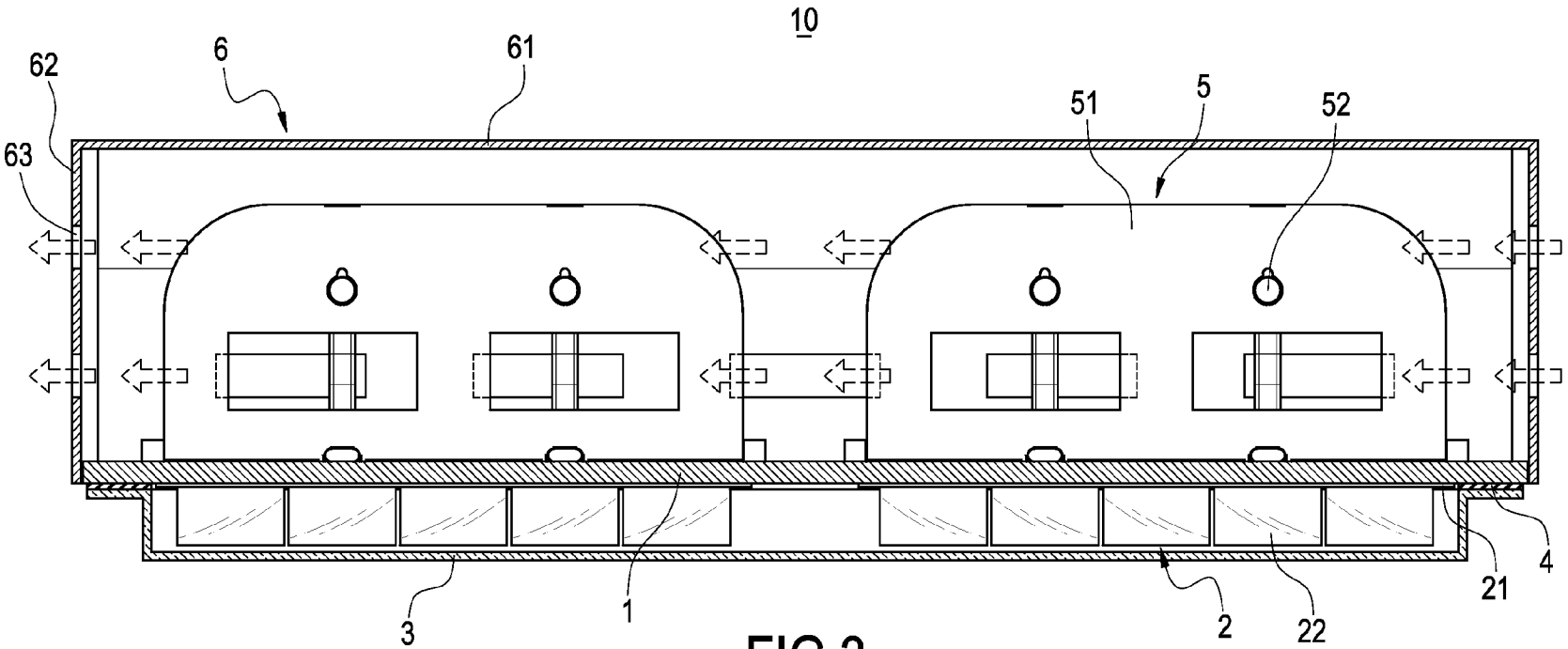
FIG. 3 is a cross-sectional view showing the operating state of the present invention.
Figure 4:
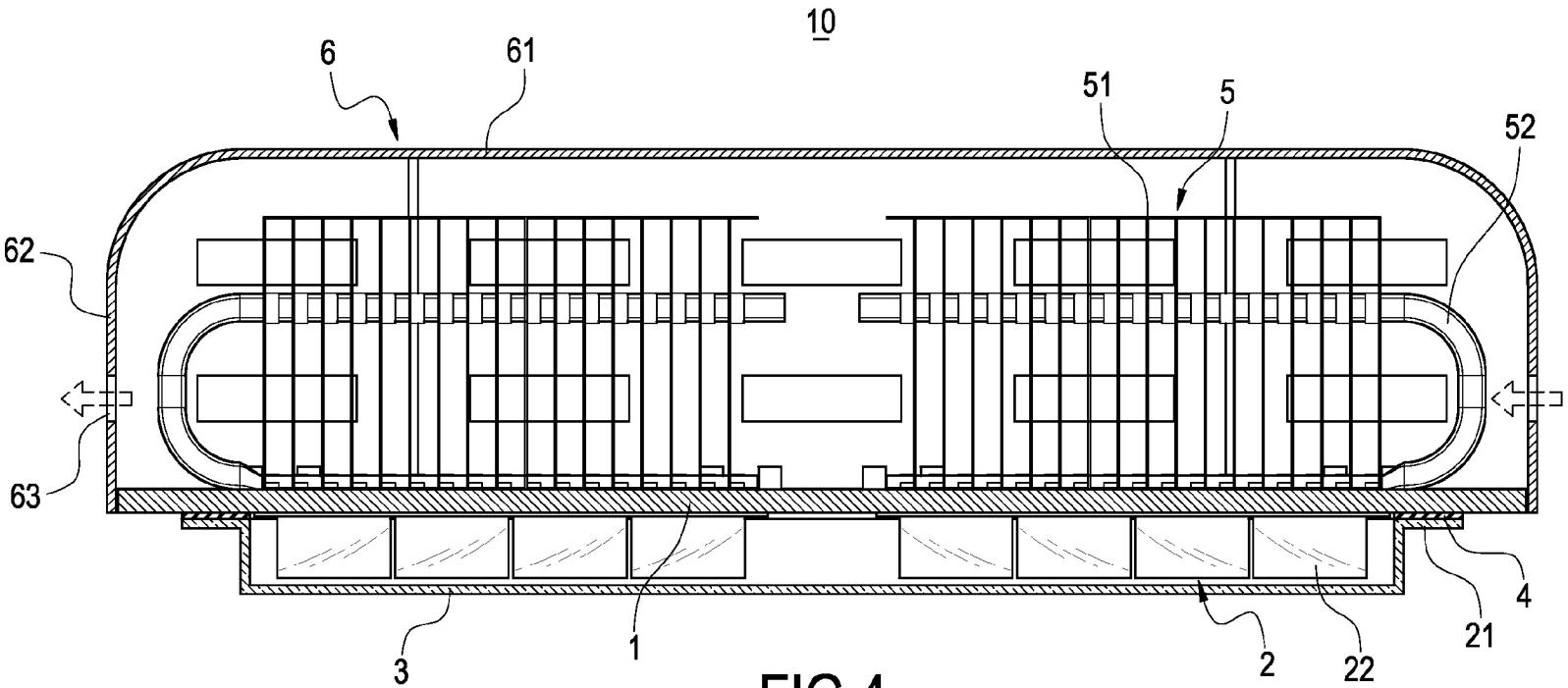
FIG. 4 is a cross-sectional view seen from another direction, showing the operating state of the present invention.

With reference to FIG. 3 and FIG. 4, in use, when the LEDs 22 are supplied with an electric current, the LED modules 2 will illuminate and generate heat. The thus-generated heat will be conducted to the substrate 1 and heat-exchanged by the heat pipes 52 contacting with the substrate 1. Therefore, the heat is heat-exchanged to the heat pipes 52. Then, the heat exchange is further performed between the heat pipes 52 and the heat-dissipating fins 51, so that the heat is conducted to the heat-dissipating fins 51. At this time, since the lamp cover 6 is provided with venting holes 63 thereon, the heat can be dissipated to the outside of the lamp cover 6 and the cooling air can flow into the lamp cover 6, thereby to increase the heat-dissipating efficiency.

Figure 5:
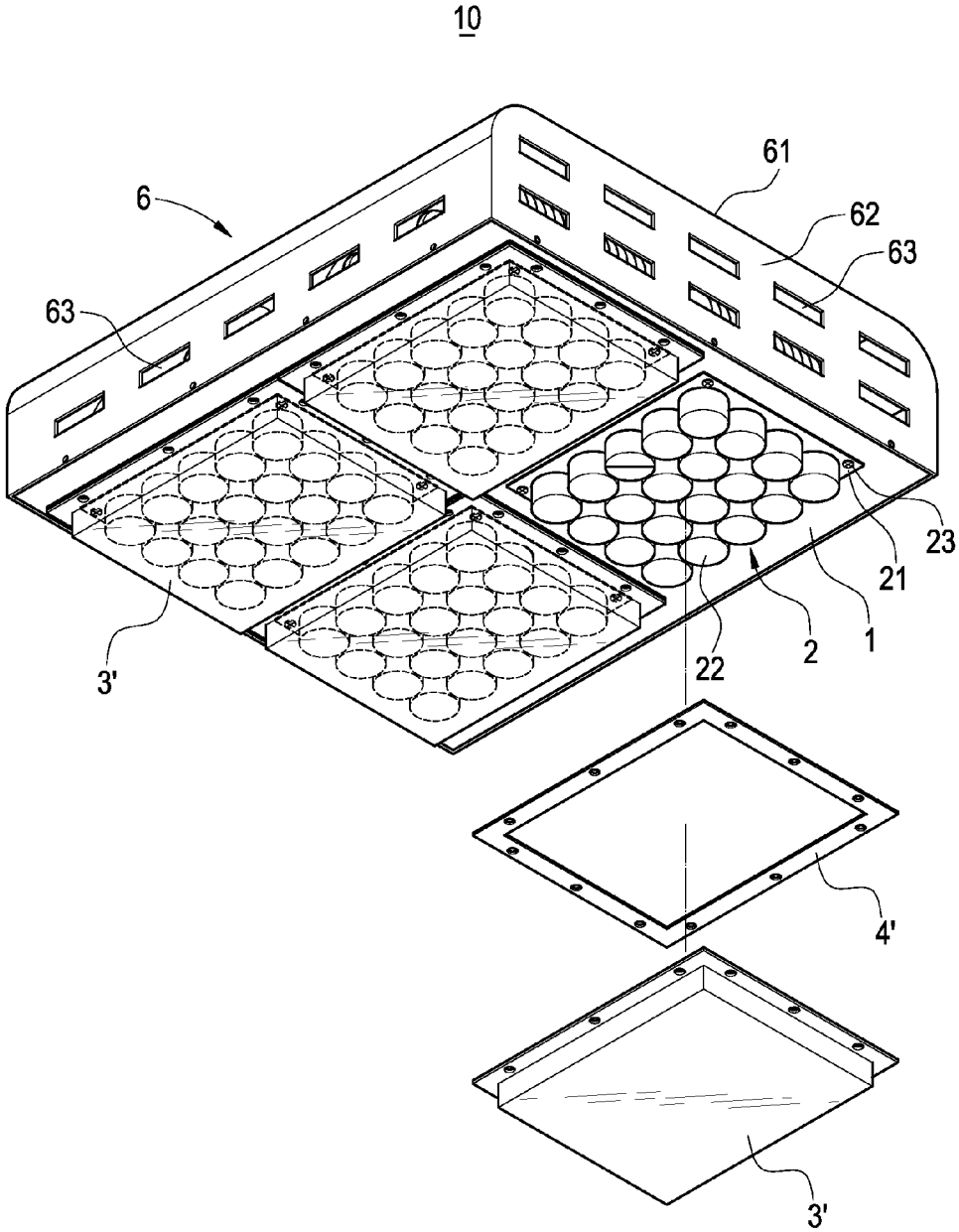
FIG. 5 is a partially assembled view of another embodiment of the present invention.
Figure 6:
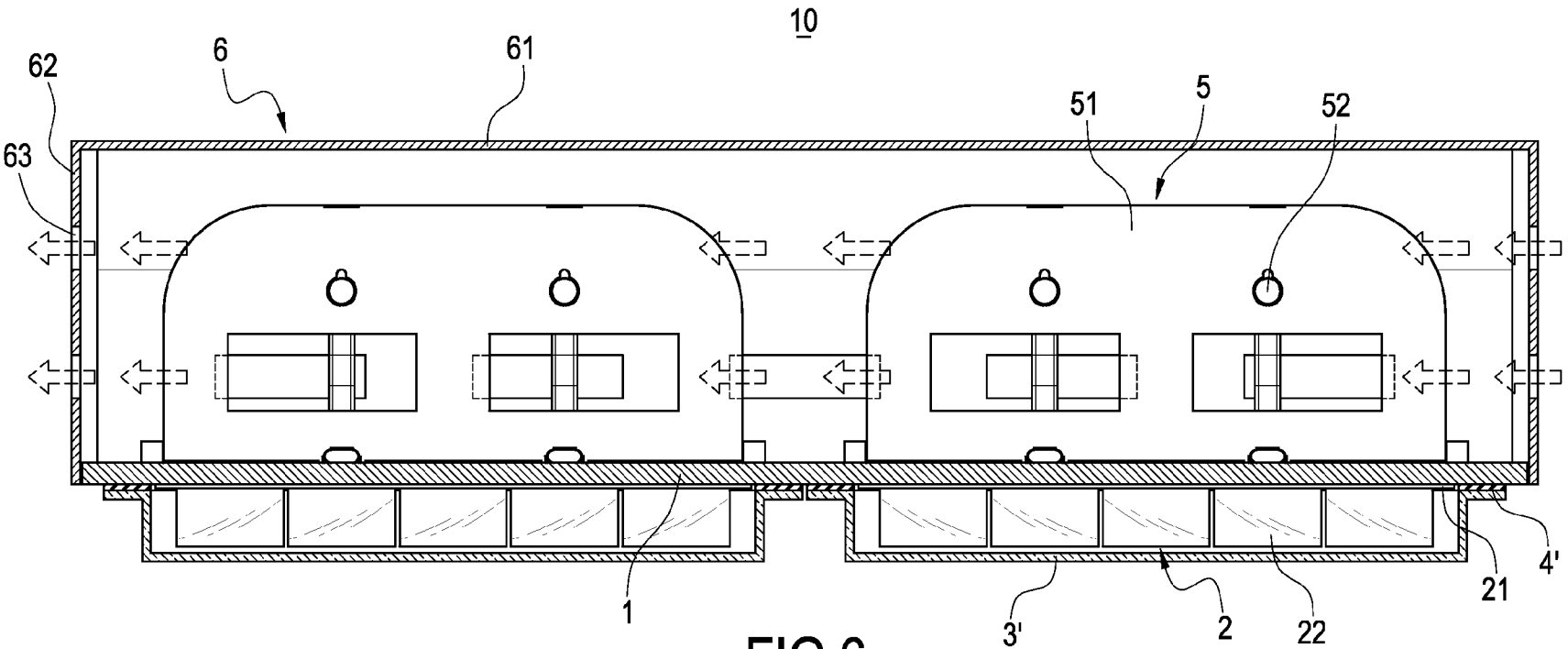
FIG. 6 is a cross-sectional view showing the operating state of FIG. 5.

With reference to FIG. 5 and FIG. 6, which show another embodiment of the present invention. In this embodiment, a plurality of small lamp masks 3' are provided. Each small lamp mask 3' is correspondingly covered on each LED module 2. For example, since there are four sets of LED modules 2 in the present embodiment, there are also four small lamp masks 3' for covering the four LED modules 2, respectively. Of course, a sealing material 4' is provided between each lamp mask 3' and the substrate 1. In the present embodiment, when a certain LED module 2 has to be replaced or repaired, only the lamp mask 3' corresponding to the LED module 2 to be replaced or repaired needs to be detached. Therefore, the time for repairing the LED lamp is further reduced.

According to the above description, it can be understand that since the large-sized LED lamp 10 of the present invention is constituted of a plurality of LED modules 2, when the LEDs 22 on a certain LED module 2 are damaged, only the damaged LED module 2 needs to be replaced without replacing or repairing all the LED modules 2. Therefore, the detachment, assembly and repair of the present invention are much simpler and more convenient.

According to the above, the present invention indeed achieves the desired effects by using the above-mentioned structure. Further, the present invention has not been published or used in public prior to filing for a patent. Therefore, the present invention involves the novelty and inventive steps, and conforms to the requirements for an invention patent.

Although the present invention has been described with reference to the foregoing preferred embodiments, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. An assembled structure of a large-sized LED lamp, comprising:

a substrate (1);

a plurality of LED modules (2) fixed on one surface of the substrate (1), each LED modules (2) comprising a circuit board (21) and a plurality of LEDs (22) fixedly connected to the circuit board (21);

a lamp mask (3) mounted on the surface of the substrate (1) provided with the LED modules (2) so as to cover the LED modules (2);

a plurality of heat-dissipating modules (5) fixedly provided on the other surface of the substrate (1), each heat-dissipating module (5) provided to correspond to each LED module (2); and a lamp cover (6) mounted on the surface of the substrate (1) provided with the heat-dissipating modules (5) so as to cover the heat-dissipating modules (5)

wherein each heat-dissipating module (5) comprises a plurality of heat-dissipating fins (51) arranged at identical intervals, two U-shaped heat pipes (52) penetrating through the heat-dissipating fins (51), and wherein a hole is formed on each heat-dissipation fin (51) so as to make a tunnel formed in the heat-dissipating module (5), and both elongated ends of each U-shaped heat pipe (52) are embedded in the heat-dissipating fins (51) to respectively locate above and beneath the tunnel while a lower elongated end of the U-shaped heat pipe (52) has a flat surface exposed out and leveled with a lower surface of the heat-dissipating module (5) so that when the heat-dissipating module (5) is fixed, the flat surface together with the lower surface are directly contacted on the surface of the substrate (1) provided with the heat-dissipating modules.

2. The assembled structure of a large-sized LED lamp according to claim 1, wherein the substrate (1) is made of heat-conducting or heat-dissipating material.

3. The assembled structure of a large-sized LED lamp according to claim 1, wherein each corner of the circuit board (21) of each LED module (2) is provided with a locking hole (211), and the substrate (1) is provided with screw holes (11) to correspond to the locking holes (211), and bolt elements (23) are used to lock the LED modules (2) on the substrate (1).

4. The assembled structure of a large-sized LED lamp according to claim 1, wherein a sealing material (4) is provided between the substrate (1) and the lamp mask (3).

5. The assembled structure of a large-sized LED lamp according to claim 4, wherein the sealing material (4) is a foam having a hollow rectangular frame.

6. The assembled structure of a large-sized LED lamp according to claim 1, wherein the shape of the periphery of the lamp mask (3) is not larger than that of the periphery of the substrate (1).

7. The assembled structure of a large-sized LED lamp according to claim 1, wherein the lamp cover (6) is constituted of a top plate (61) and a plurality of surrounding plates (62) extending downwardly from the periphery of the top plate (61), and each surrounding plate (62) is provided with a plurality of venting holes (63).

8. The assembled structure of a large-sized LED lamp according to claim 1, wherein the lamp mask is constituted of a plurality of small lamp masks (3'), and each small lamp mask (3') is covered on the exterior of each LED module (2), respectively.

* * * * *